US005658718A

United States Patent [19]

Canuti et al.

[11] Patent Number: 5,658,718

[45] Date of Patent: Aug. 19, 1997

[54] SILVER HALIDE COLOR PHOTOGRAPHIC ELEMENTS

[75] Inventors: Anna Maria Canuti, Genova; Roberto Sardelli, Savona; Massimo Bertoldi, Fossano, all of Italy

[73] Assignee: Imation Corp, Oakdale, Minn.

[21] Appl. No.: 577,979

[22] Filed: Dec. 22, 1995

[30] Foreign Application Priority Data

Feb. 1, 1995 [EP] European Pat. Off. ..... 95101340

[51] Int. Cl.[6] ..... G03C 1/46

[52] U.S. Cl. ..... 430/504; 430/359; 430/559; 430/561; 430/562; 430/563; 430/517; 430/519; 430/552; 430/553

[58] Field of Search ..... 430/503, 504, 430/359, 559, 561, 562, 563, 552, 553, 517, 519

[56] References Cited

U.S. PATENT DOCUMENTS

| | | | |
|---|---|---|---|
| 4,138,258 | 2/1979 | Hirose et al. | 430/562 |
| 4,439,513 | 3/1984 | Sato et al. | 430/559 |
| 4,473,631 | 9/1984 | Hirai et al. | 430/559 |
| 4,500,626 | 2/1985 | Naito et al. | 430/559 |
| 4,503,137 | 3/1985 | Sawada | 430/559 |
| 4,555,470 | 11/1985 | Sakaguchi et al. | 430/559 |
| 4,559,290 | 12/1985 | Sawada et al. | 430/559 |
| 4,606,991 | 8/1986 | Kawata et al. | 430/559 |
| 4,628,021 | 12/1986 | Sawada et al. | 430/559 |
| 5,370,979 | 12/1994 | Kume | 430/359 |

FOREIGN PATENT DOCUMENTS

| | | |
|---|---|---|
| 650 453 | 7/1964 | Belgium . |
| 0 087 930 A1 | 7/1993 | European Pat. Off. . |
| WO91/06037 | 5/1991 | WIPO . |

*Primary Examiner*—Geraldine Letscher
*Attorney, Agent, or Firm*—Mark A. Litman

[57] ABSTRACT

Multilayer silver halide color photographic element comprising a support having thereon at least a blue sensitive silver halide emulsion layer containing a yellow dye-forming coupler, at least a green-sensitive silver halide emulsion layer containing a magenta dye-forming coupler, and at least a red-sensitive silver halide emulsion layer containing a cyan dye-forming coupler, said red-sensitive layer containing a non-diffusible, cyan dye-forming magenta masking coupler.

9 Claims, No Drawings

SILVER HALIDE COLOR PHOTOGRAPHIC ELEMENTS

FIELD OF THE INVENTION

The present invention relates to silver halide color photographic elements emulsions and, more particularly, multilayer silver halide color negative photographic elements comprising non-diffusible, non-coupling magenta azo dyes and non-diffusible, cyan dye-forming magenta masking couplers.

BACKGROUND OF THE ART

Silver halide color photographic elements, based on the three primary (i.e., yellow, magenta and cyan) color principle of the subtractive color process, are substantially composed of at least one blue-sensitive (or blue-sensitized) silver halide emulsion layer which is colored (upon color processing) yellow by the action of blue (from 400 to 500 nm) light, at least one green-sensitized silver halide emulsion layer which is colored (upon color processing) magenta by the action of green (from 500 to 600 nm) light, and at least one red-sensitized silver halide emulsion layer which is colored (upon color processing) cyan by the action of red (from 600 to 700 nm) light.

It is well known that cyan, magenta and yellow image dyes are formed by the imagewise coupling reaction of oxidized aromatic primary amino developing agents with color-forming compounds or couplers. Usually, phenol or naphthol couplers are used to form the cyan dye image; 5-pyrazolone, pyrazolotriazole or pyrazolobenzimidazole couplers are used to form the magenta dye image; and open-chain ketomethylene couplers are used to form the yellow dye image.

Ideally, in such color photographic elements, the yellow dye image formed absorbs blue light only, the magenta dye image absorbs green light only, and the cyan dye image absorbs red light only.

Unfortunately, the absorption spectra of conventional dyes formed from the color-forming couplers are never "clean". Thus, the cyan dye, which should absorb red light and transmit green and blue light, usually absorbs a considerable amount of green and blue light as well as a major proportion of the red light.

As a means for removing such unwanted absorption, i.e., absorption at wavelengths lower than about 600 nm, there is generally practiced in the art the so called masking method, in which a colored image forming coupler (namely colored masking coupler) is used in addition to the cyan image-forming coupler that is to be color corrected, as described in detail in *J. Phot. Soc. Am.* 13, 94 (1947), *J. Opt. Soc. Am.* 40, 166 (1950) or *J. Am. Chem Soc.* 72, 1533 (1950). The colored masking coupler absorbs both green and blue light and is capable of reacting with oxidized color developer (during the color development processing step) to yield the cyan image dye while simultaneously losing its ability, in proportion to development, to absorb in the green and blue regions of the spectrum, thereby correcting for the unwanted green and blue absorption of the cyan dye derived from the main cyan dye-forming coupler in the photographic element.

To correct the unwanted absorption of the cyan image-dye, phenol or naphthol couplers usually are used which are colored by virtue of containing a chromophore group which is split off or destroyed during and by means of the coupling reaction with the result that the original color of the colored coupler is destroyed and a cyan dye is formed upon coupling. Colored cyan dye-forming couplers are described, for instance, in U.S. Pat. Nos. 2,449,966, 2,453,661, 2,445,169, 2,455,170, 2,521,908, 2,706,684, 3,476,563, 4,004,929, 4,138,258, and 4,458,012. Usually, such colored cyan dye-forming couplers are higher in reactivity than the main cyan dye-forming coupler, so that, in order to reach the right level of density necessary to achieve a good color reproduction, it is necessary to use an excess of cyan dye-forming masking coupler ("overmasking") causing a reduction in speed of the magenta layer and an inferior color rendition. Another shortcoming that exists with respect to the use of color-correcting couplers relates to their color prior to their reaction with oxidized color developer. In fact, the color density of multilayer silver halide color photographic elements (before color processing), both in terms of peak absorption and minimum optical density)-must match the setting of photo-finishing printers to attain a printing compatibility with all color photographic elements available on the market.

Despite all of the efforts practiced in the art, however, a fully adequate degree of color correction has not been attained by the above masking methods as required for a multilayer color photographic element. There is a need to provide a multilayer color photographic element showing improved color correction.

Magenta colored azo dyes comprising water soluble groups and hydrophobic groups have been described as bleaching dyes for photothermographic recording materials in JP 59-184,340 and JP 61-120,143, as dyes for ink jet recording in JP 93-80,955, as light fast dyes in *Zhur. Priklad. Khim.*, 33, 1617–23 (1960), and as dyes for the construction of optical devices in GB 2,204,053.

WO 91/06037 describes a photographic material comprising a non-diffusible yellow and a non-diffusible magenta azomethine dye in an interlayer between a fast cyan layer and a,slow magenta layer.

EP 550,109 describes a silver halide color photographic material comprising a water soluble magenta colored azo dye in a magenta layer.

SUMMARY OF THE INVENTION

The present invention relates to a multilayer silver halide color photographic element comprising a support having thereon at least a blue sensitive silver halide emulsion layer containing a yellow dye-forming coupler, at least a green-sensitive silver halide emulsion layer containing a magenta dye-forming coupler, and at least a red-sensitive silver halide emulsion layer containing a cyan dye-forming coupler, wherein said red-sensitive layer contains a non-diffusible, non-coupling magenta colored azo dye and a non-diffusible, cyan dye-forming magenta masking coupler.

The combination of non-diffusible, non-coupling magenta azo dyes and non-diffusible, cyan dye-forming magenta masking couplers according to the present invention provide an improved cyan color correction in multilayer silver halide color photographic elements, attaining the right masking density for printing compatibility without reducing speed in the magenta layer.

DETAILED DESCRIPTION OF THE INVENTION

The non-diffusible, non-coupling magenta colored azo dyes used in the color photographic elements of this invention have their main absorption in the wave length region of about 500 to 600 nm with a sharp absorption curve similar to that of non-diffusible, cyan dye-forming magenta masking couplers, are fixed in a photographic layer without substantially migrating out of the layer in which they have been incorporated before the photographic element has been processed, and retain their color after photographic processing. Said non-diffusible magenta colored azo dyes differ from the non-diffusible, cyan dye-forming magenta masking couplers used in the photographic art for color-correction purposes, which masking couplers imagewise release a diffusible dye by coupling with the oxidation product of a primary aromatic amine developing agent during color development. They differ also from preformed azomethine image coupler dyes which have a broader absorption curve. Additionally, they are very easy to prepare inexpensively, and can be introduced into the photographic layers very easily.

The non-diffusible, non-coupling magenta colored azo dye used in this invention can be represented by the following general formula (I)

[Ar]—N=N—[Ph] (1)

wherein Ar represents an aryl group, such as a phenyl group or a naphthyl group, Ph represents a phenyl group. Said dye comprises at least a water soluble group and at least a ballast group attached to Ar or Ph. Examples of water soluble groups include, for example, —$SO_3M$ and —COOM where M is a hydrogen atom or a cation. Particularly useful cations include alkali metal cations such as, for example, sodium and potassium, and N-containing cations such as, for example, ammonium, methylammonium, ethylammonium, diethylammonium, triethylammonium, ethanolammonium, diethanolammonium, and the like, as well as species that can be derived by neutralizing carboxylic and sulfonic acid groups with cyclic amines such as, for example, pyridine, piperidine, aniline, toluidine, p-nitroaniline, and the like. To render the dye non-diffusible from the layer in which it is coated in a photographic element, an organic group having a hydrophobic residue having 8 to 32 carbon atoms is introduced into the Ar or Ph portions of the molecule of the dye. Such a group is called a "ballast group". The ballast group can be bonded to the dye directly or through an imino bond, an ether bond, a thioether bond, a carbonamido bond, a sulfonamido bond, a ureido bond, an ester bond, an imido bond, a carbamoyl bond, a sulfamoyl bond, etc. Specific examples of suitable ballast groups include alkyl groups (linear, branched or cyclic), alkenyl groups, alkoxy alkyl groups, alkylaryl groups, alkylaryloxyalkyl groups, acylamidoalkyl groups, alkoxyaryl groups, aryloxyaryl groups, alkyl groups substituted with an ester group, alkyl groups substituted with an aryl group or a heterocyclic group, aryl groups substituted with an aryloxyalkoxycarbonyl group, and residues containing both an alkyl or alkenyl long-chain aliphatic group and a carboxyl or sulfo water-soluble group, as described for example in U.S. Pat. Nos. 3,337,344, 3,418,129, 3,892,572, 4,138,258, and 4,451,559.

In particular, the non-diffusible, non coupling magenta colored azo dye are preferably represented by the following general formula (II):

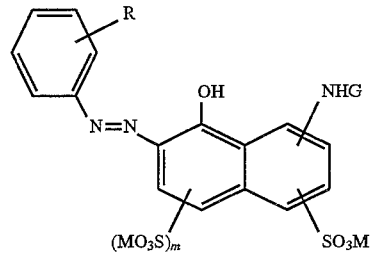

(II)

wherein M is a hydrogen atom or a cation (such as an alkali metal ion, an ammonium ion, etc.), m is an integer of 0 or 1, G represents an acyl group or an alkylsulfonyl group, preferably having 1 to 4 carbon atoms, or an arylsulfonyl group, preferably having 6 to 8 carbon atoms, and R represents a ballast group.

More preferably, the non-diffusible, non-coupling magenta colored azo dyes for use in the present invention are represented by the following general formula (III):

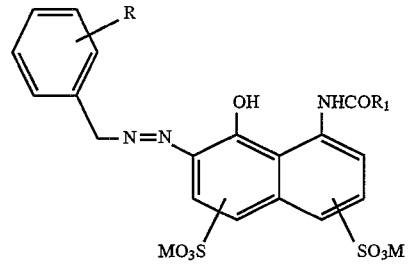

(III)

wherein M and R are as described before, and $R_1$ represents an alkyl group, preferably having 1 to 4 carbon atoms (such as, for example, methyl, ethyl, t-butyl).

When the term "group" is used in this invention to describe a chemical compound or substituent, the described chemical material includes the basic group and that group with conventional substitution. Where the term "moiety" is used in this invention to describe a chemical compound or substituent, only the unsubstituted chemical material is intended to be included. For example, "alkyl group" includes not only such alkyl moiety as methyl, ethyl, octyl, stearyl, etc., but also moieties bearing substituent groups such as halogen, cyano, hydroxyl, nitro, amino, carboxylate, etc. On the other hand, "alkyl moiety" includes only methyl, ethyl, octyl, stearyl, cyclohexyl, etc.

Specific examples of non-diffusible, non-coupling magenta colored azo dyes for use in the present invention are illustrated below, but the present invention should not be construed as being limited thereto.

AD-1

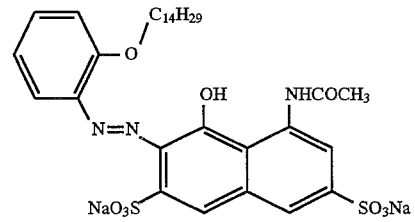

-continued

AD-2

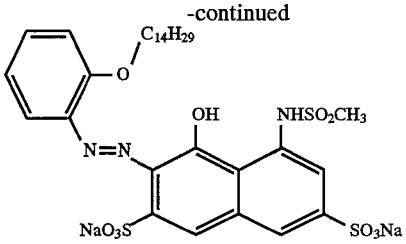

AD-3

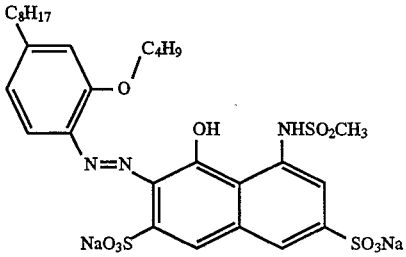

AD-4

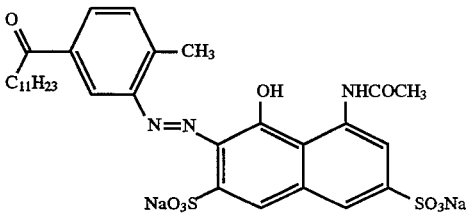

AD-5

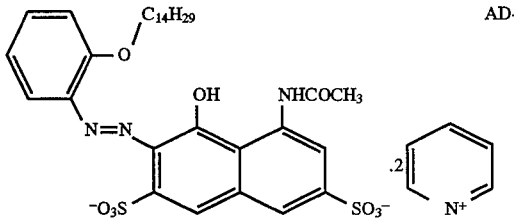

AD-6

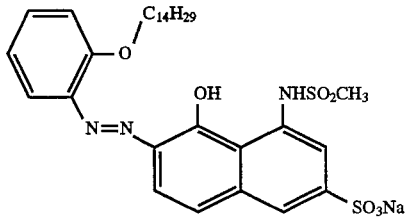

AD-7

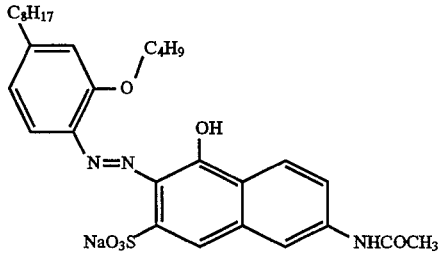

AD-8

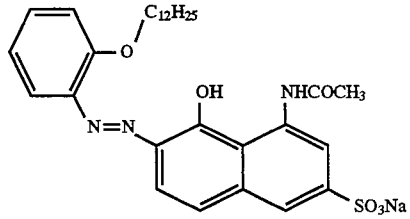

Methods are known for manufacturing the non-coupling, non-diffusible magenta azo dyes used for color separation according to the present invention. For example, the synthesis of AD-1 is shown specifically by reference to the following Synthesis Example.

Synthesis Example 210 g of 1-naphthol-8-amino-3,6-disulfonic acid monosodium salt were suspended in 102 g of acetic anhydride and 600 ml of acetic acid. Then, 200 ml of triethylamine were added. The reaction mixture was heated to 110° C. under stirring for 1.5 hours. The solution was cooled to 60° C. and 400 ml of water and 230 ml of pyridine were added (Solution A).

152 g of tetradecyloxyaniline were dissolved in 2400 ml of acetone. Then, 135 ml of HCl (37% by weight) were added dropwise under stirring at 20°–25° C. until complete salt precipitation. Then, the reaction mixture was cooled to 0°–5° C. and a solution of 38 g of $NaNO_2$ in 400 ml of water was added dropwise (Solution B).

The Solution B was added to Solution A and the mixture was stirred for 2 hours. Then, the solid was collected by filtration, washed with acetone and water, then crystallized from water. The yield was 90% of dye having the formula AD-1 ($\lambda$max=557.2 nm, $\epsilon$=36,006 in methanol), confirmed by the $^1$H-NMR spectrum and the following elemental analysis:

Theoretical: C%=53.25, H%=5.73, N%=5.82, S%=8.88. Found: C%=53.32, H%=5.70, N%=6.03, S%=8.51.

In the multilayer color photographic elements of this invention, the non-diffusible, non-coupling magenta colored azo dyes can be incorporated in a red-sensitive silver halide emulsion layer together with a colorless cyan dye-forming coupler. The total amount of non-diffusible, non-coupling magenta colored azo dyes used in the multilayer color photographic elements of this invention depends upon the purpose of the color photographic elements and the structure of the dyes and of the non-diffusible, cyan dye-forming magenta masking couplers, but it is preferably about 10 to 200 mg/m$^2$, in particular 20 to 100 mg/m$^2$. The non-coupling magenta azo dye may also be similarly used in false color address multilayer silver halide photographic systems such as disclosed in U.S. Pat. No. 4,619,892 by appropriately locating the dye adjacent to the appropriate color-forming layer to act as a mask.

Various methods can be employed to incorporate the non-diffusible, non-coupling magenta colored azo dyes in the coating compositions used for forming the layers of the color photographic elements according to this invention. For example, the non-diffusing, non-coupling magenta colored azo dyes may be added to the coating compositions as an aqueous solution, such as a 2% by weight aqueous solution. Other methods to incorporate the dyes are described as follows.

(a) The azo dye is dissolved in water in the presence of a minor amount (such as, for example, less than 10%, preferably less than 5% by weight) of a water-soluable organic solvent (such as, for example, methanol, ethanol, acetone, dimethylformamide, dimethylsulfoxide, phenylcellosolve, or a mixture of these organic solvent) and a surface active agent (such as, for example, an anionic surface active agent of the alkane sulfonate type), and then the solution of the azo dye is added to a coating composition for the color photographic element.

(b) The non-diffusing magenta colored azo dye is dissolved in an aqueous solution of gelatin (containing, for example, from 2 to 10% by weight of dry gelatin) at 40° C., and then the solution of the azo dye is added to a coating composition for the color photographic element.

The non-diffusible, cyan dye-forming magenta masking couplers used in this invention in combination with the non-diffusible, non-coupling magenta azo dyes can be represented by the following general formula (IV):

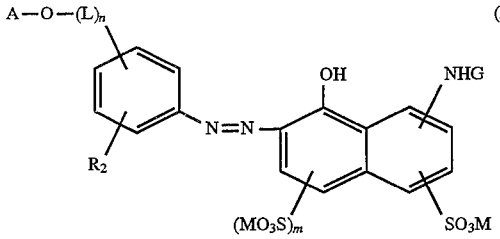

(IV)

wherein A represents a cyan coupler residue, L represents a divalent linking group connected to the coupling position of the cyan coupler through O, n is an integer of 0 or 1, $R_2$ represents a photographically inactive monovalent group, M represents a hydrogen atom or a cation, m is an integer of 0 or 1, and G represents an acyl group, or an alkysulfonyl group, preferably having 1 to 4 carbon atoms, or an arylsulfonyl group, preferably having 6 to 8 carbon atoms.

In the formula (IV) above, A preferably represents a cyan coupler residue such as a phenol or naphthol cyan coupler residue. L represents a divalent linking group such as, for example, $—CH_2—$, $—CH_2CH_2—$, $—CH_2CH_2O—$, $—CH_2CH(OH)CH_2O—$, $—CH_2CH_2OCH_2CH_2O—$, $—CONHCH_2—$, $—CONHCH_2—$, $—CH_2CONH—$, $—CH_2COO—$, $—SO_2(CH_2)_2O—$, —CONH—, —CO—, $—COCH_2—$

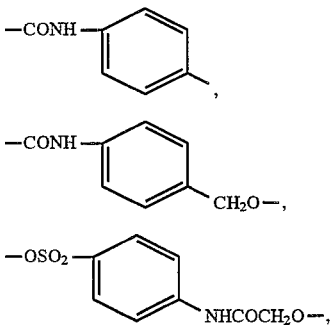

and $—SO_2(CH_2)_4O—$. $R_2$ represents a photographically inert group such as, for example, a hydrogen atom, a halogen atom (e.g., fluorine, bromine, chlorine), a cyano group, a hydroxy group, a nitro group, an alkyl group (e.g., methyl, t-butyl, octyl, benzyl), an aryl group (e.g., phenyl, 2-chlorophenyl, naphthyl), an alkoxy group (e.g., methoxy, butoxy, benzyloxy), an aryloxy group (e.g., phenoxy, p-t-butylphenoxy, naphthoxy), an amino group, a sulfamoyl group, a carbamoyl group,, and an alkoxycarbonyl group. M and G have the same meaning as inn general formula (I) or (III).

Specific examples of non-diffusible, cyan dye-forming magenta masking couplers for use in this invention represented by the formula (IV) are illustrated below, but the present invention is not limited thereto.

CM-1

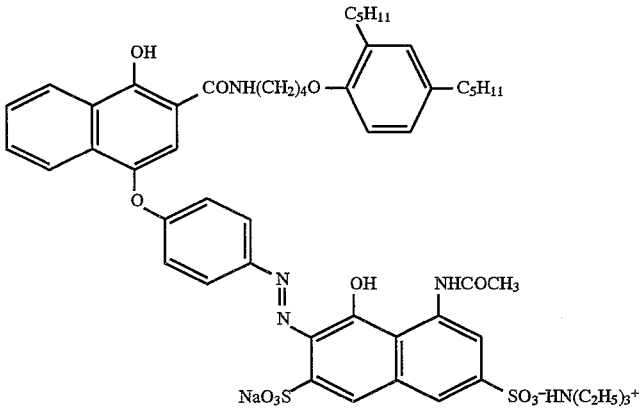

CM-2

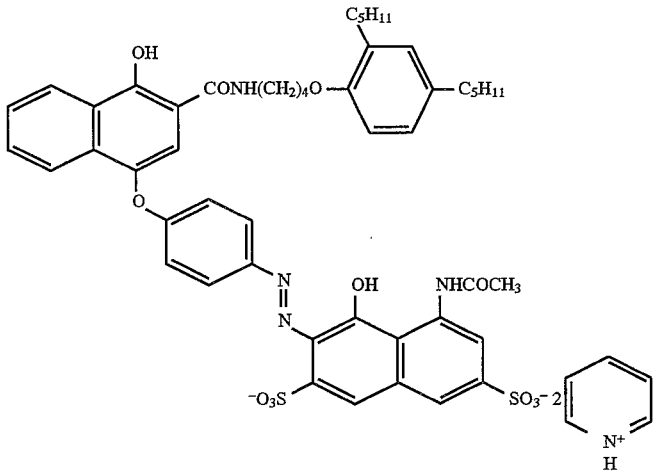

-continued
CM-3
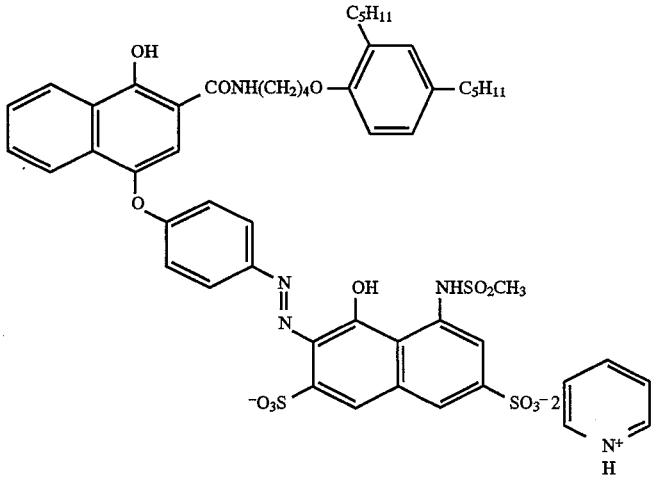
CM-4
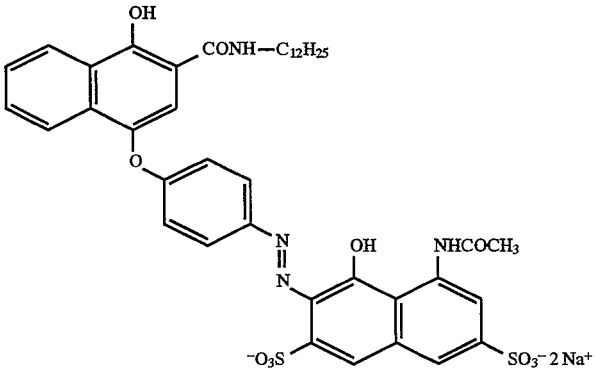
CM-5
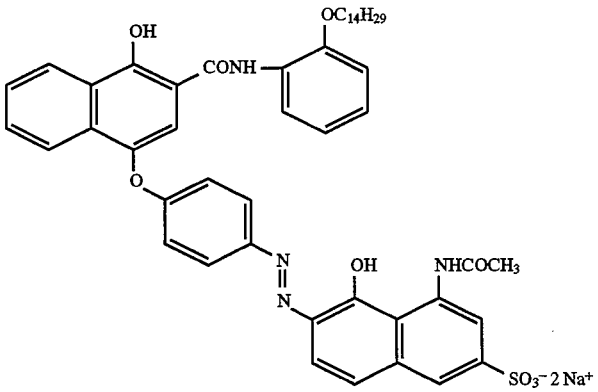
CM-6
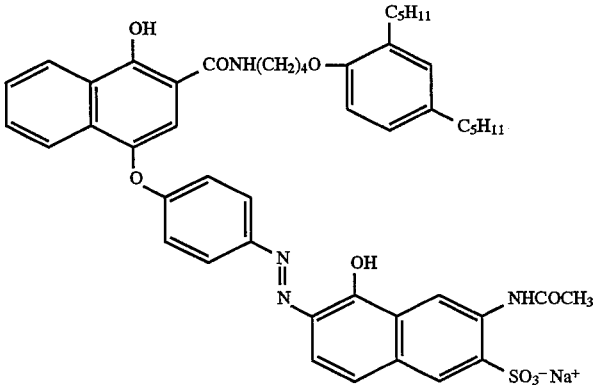

-continued

CM-7

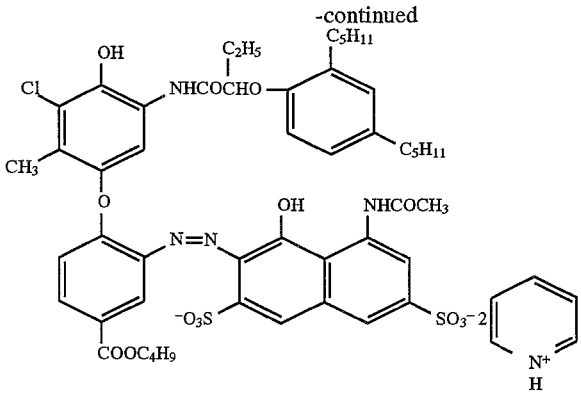

CM-8

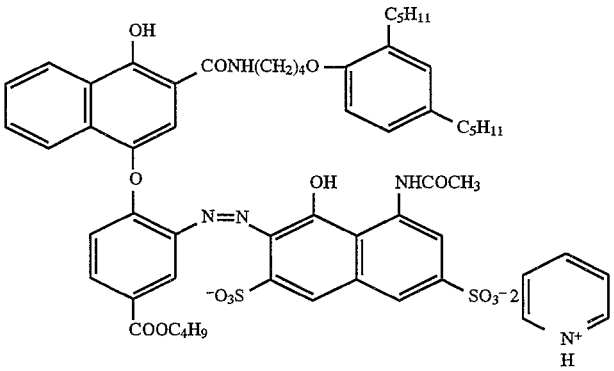

CM-9

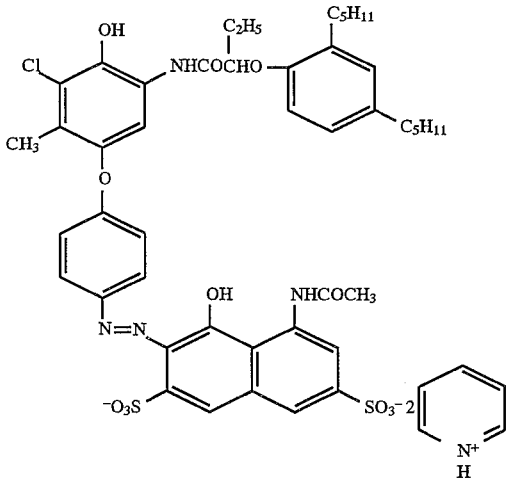

CM-10

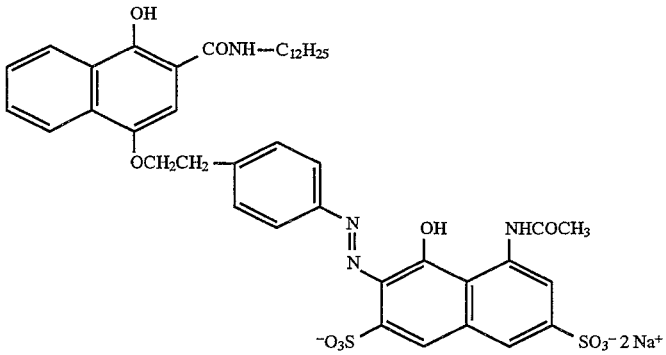

The above non-diffusible, cyan dye-forming masking couplers can be synthesized with methods known in the art, such as, for example, those described in U.S. Pat. Nos. 3,476,563, 4,004,929 and 4,138,258.

In the multilayer color photographic elements of this invention, the non-diffusible, cyan dye-forming magenta masking coupler can be incorporated in a red-sensitive silver halide emulsion layer individually or together with a colorless cyan dye-forming coupler and/or the non-diffusible, non-coupling magenta colored azo dye. The total amount of non-diffusible, cyan dye-forming magenta masking couplers used in the multilayer color photographic elements of this invention depends upon the purpose of the color photographic elements and the structure of the couplers, but it is preferably about 10 to 500 mg/m$^2$, in particular 50 to 250 mg/m$^2$.

The couplers represented by the formula (IV), namely the non-diffusible, cyan dye-forming magenta masking couplers can be generally dissolved in either water or an organic solvent, and the solution incorporated in the coating compositions of the multilayer silver halide color photographic element. For example, they can be dissolved in water in the presence of a surfactant, an auxiliary solvent such as acetone, ethanol, etc. or in the presence of an alkali.

The color photographic elements of the present invention can be conventional photographic elements containing a silver halide as a light-sensitive substance.

The silver halides used in the multilayer color photographic elements of this invention may be a fine dispersion (emulsion) of silver chloride, silver bromide, silver chlorobromide, silver iodo-bromide and silver chloro-iodobromide grains in a hydrophilic binder. Preferred silver halides are silver iodo-bromide or silver iodo-bromo-chloride containing 1 to 20% mole silver iodide. In silver iodo-bromide emulsions or silver iodo-bromo-chloride, the iodide can be uniformly distributed among the emulsion grains, or iodide level can varied, among the grains. The silver halides can have a uniform grain size or a broad grain size distribution. The silver halide grains may be regular grains having a regular crystal structure such as cubic, octahedral, and tetradecahedral, or the spherical or irregular crystal structure, or those having crystal defects such as twin plane, or those having a tabular form, or the combination thereof.

The term "cubic grains" according to the present invention is intended to include substantially cubic grains, that is grains which are regular cubic grains bounded by crystallographic faces (100), or which may have rounded edges and/or vertices or small faces (111), or may even be nearly spherical when prepared in the presence of soluble iodides or strong ripening agents, such as ammonia. Particularly good results are obtained with silver halide grains having average grain sizes in the range from 0.2 to 3 μm, more preferably from 0.4 to 1.5 μm. Preparation of silver halide emulsions comprising cubic silver iodobromide grains is described, for example, in Research Disclosure, Vol. 184, Item 18431, Vol. 176, Item 17644 and Vol. 308, Item 308119.

Other silver halide emulsions for use in this invention are those which employ one or more light-sensitive tabular grain emulsions. The tabular silver halide grains contained in the emulsion of this invention have an average diameter:thickness ratio (often referred to in the art as aspect ratio) of at least 2:1, preferably 2:1 to 20:1, more preferably 3:1 to 14:1, and most preferably 3:1 to 8:1. Average diameters of the tabular silver halide grains suitable for use in this invention range from about 0.3 μm to about 5 μm, preferably 0.5 μm to 3 μm, more preferably 0.8 μm to 1.5 μm. The tabular silver halide grains suitable for use in this invention have a thickness of less than 0.4 μm, preferably less than 0.3 μm and more preferably less than 0.2 μm.

The tabular grain characteristics described above can be readily ascertained by procedures well known to those skilled in the art. The term "diameter" is defined as the diameter of a circle having an area equal to the projected area of the grain. The term "thickness" means the distance between two substantially parallel main planes constituting the tabular silver halide grains. From the measure of diameter and thickness of each grain the diameter:thickness ratio of each grain can be calculated, and the diameter:thickness ratios of all tabular grains can be averaged to obtain their average diameter:thickness ratio. By this definition, the average diameter:thickness ratio is the average of individual tabular grain diameter:thickness ratios. In practice, it is simpler to obtain an average diameter and an average thickness of the tabular grains and to calculate the average diameter:thickness ratio as the ratio of these two averages. Whatever the used method may be, the average diameter:thickness ratios obtained do not greatly differ.

In the silver halide emulsion layer containing tabular silver halide grains, at least 15%, preferably at least 25%, and, more preferably, at least 50% of the silver halide grains are tabular grains having an average diameter:thickness ratio of not less than 2:1. Each of the above proportions, "15%", "25%" and "50%" means the proportion of the total projected area of the tabular grains having a diameter:thickness ratio of at least 2:1 and a thickness lower than 0.4 μm, as compared to the projected area of all of the silver halide grains in the layer.

It is known that photosensitive silver halide emulsions can be formed by precipitating silver halide grains in an aqueous dispersing medium comprising a binder, gelatin preferably being used as a binder.

The silver halide grains may be precipitated by a variety of conventional techniques. The silver halide emulsion can be prepared using a single-jet method, a double-jet method, or a combination of these methods or can be matured using, for instance, an ammonia method, a neutralization method, an acid method, or can be performed an accelerated or constant flow rate precipitation, interrupted precipitation, ultrafiltration during precipitation, etc. References can be found in Trivelli and Smith, The Photographic Journal, Vol. LXXIX, May 1939, pp. 330–338, T. H. James, The Theory of The Photographic Process, 4th Edition, Chapter 3, U.S. Pat. Nos. 2,222,264, 3,650,757, 3,917,485, 3,790,387, 3,716,276, 3,979,213, Research Disclosure, December 1989, Item 308119 "Photographic Silver Halide Emulsions, Preparations, Addenda, Processing and Systems", and Research Disclosure, September 1976, Item 14987.

One common technique is a batch process commonly referred to as the double-jet precipitation process by which a silver salt solution in water and a halide salt solution in water are concurrently added into a reaction vessel containing the dispersing medium.

In the double jet method, in which alkaline halide solution and silver nitrate solution are concurrently added in the gelatin solution, the shape and size of the formed silver halide grains can be controlled by the kind and concentration of the solvent existing in the gelatin solution and by the addition speed. Double-jet precipitation processes are described, for example, in GB 1,027,146, GB 1,302,405, U.S. Pat. No. 3,801,326, U.S. Pat. No. 4,046,376, U.S. Pat. No. 3,790,386, U.S. Pat. No. 3,897,935, U.S. Pat. No. 4,147,551, and U.S. Pat. No. 4,171,224.

The single jet method in which a silver nitrate solution is added in a halide and gelatin solution has been long used for manufacturing photographic emulsion. In this method, because the varying concentration of halides in the solution determines which silver halide grains are formed, the formed silver halide grains are a mixture of different kinds of shapes and sizes.

Precipitation of silver halide grains usually occurs in two distinct stages. In a first stage, nucleation, formation of fine silver halide grain occurs. This is followed by a second stage, the growth stage, in which additional silver halide formed as a reaction product precipitates onto the initially formed silver halide grains, resulting in a growth of these silver halide grains. Batch double-jet precipitation processes are typically undertaken under conditions of rapid stirring of reactants in which the volume within the reaction vessel continuously increases during silver halide precipitation and soluble salts are formed in addition to the silver halide grains.

In order to avoid soluble salts in the emulsion layers of a photographic material from crystallizing out after coating and other photographic or mechanical disadvantages (stickiness, brittleness, etc.), the soluble salts formed during precipitation have to be removed.

In preparing the silver halide emulsions for use in the present invention, a wide variety of hydrophilic dispersing agents for the silver halides can be employed. As hydrophilic dispersing agent, any hydrophilic polymer conventionally used in photography can be advantageously employed including gelatin, a gelatin derivative such as acylated gelatin, graft gelatin, etc., albumin, gum arabic, agar agar, a cellulose derivative, such as hydroxyethylcellulose, carboxymethylcellulose, etc., a synthetic-resin, such as polyvinyl alcohol, polyvinylpyrrolidone, polyacrylamide, etc. Other hydrophilic materials useful known in the art are described, for example, in Research Disclosure, Vol. 308, Item 308119, Section IX.

The silver halide grain emulsion for use in the present invention can be chemically sensitized using sensitizing agents known in the art. Sulfur containing compounds, gold and noble metal compounds, and polyoxylakylene compounds are particularly suitable. In particular, the silver halide emulsions may be chemically sensitized with a sulfur sensitizer, such as sodium thiosulfate, allylthiocyanate, allylthiourea, thiosulfinic acid and its sodium salt, sulfonic acid and its sodium salt, allylthiocarbamide, thiourea, cystine, etc.; an active or inert selenium sensitizer; a reducing sensitizer such as stannous salt, a polyamine, etc.; a noble metal sensitizer, such as gold sensitizer, more specifically potassium aurithiocyanate, potassium chloroaurate, etc.; or a sensitizer of a water soluble salt such as for instance of ruthenium, rhodium, iridium and the like, more specifically, ammonium chloropalladate, potassium chloroplatinate and sodium chloropalladite, etc.; each being employed either alone or in a suitable combination. Other useful examples of chemical sensitizers are described, for example, in Research Disclosure 17643, Section III, 1978 and in Research Disclosure 308119, Section III, 1989.

The silver halide emulsion for use in the present invention can be spectrally sensitized with dyes from a variety of classes, including the polymethyne dye class, which includes the cyanines, merocyanines, complex cyanines and merocyanines, oxonols, hemioxonols, styryls, merostyryls, and streptocyanine.

The cyanine spectral sensitizing dyes include, joined by a methine linkage, two basic heterocyclic nuclei, such as those derived from quinoline, pyrimidine, isoquinoline, indole, benzindole, oxazole, thiazole, selenazole, imidazole, benzoxazole, benzothiazole, benzoselenazole, benzoimidazole, naphthoxazole, naphthothiazole, naphthoselenazole, tellurazole, oxatellurazole.

The merocyanine spectral sensitizing dyes include, joined by a methine linkage, a basic heterocyclic nucleus of the cyanine-dye type and an acidic nuceleus, which can be derived from barbituric acid, 2-thiobarbituric acid, rhodanine, hydantoin, 2-thiohydantoin, 2-pirazolin-5-one, 2-isoxazolin-5-one, indan-1,3-dione, cyclohexane-1,3-dione, 1,3-dioxane-4,6-dione, pyrazolin-3,5-dione, pentane-2,4-dione, alkylsulfonylacetonitrile, malononitrile, isoquinolin-4-one, chromane-2,4-dione, and the like.

One or more spectral sensitizing dyes may be used. Dyes with sensitizing maxima at wavelengths throughout the visible and infrared spectrum and with a great variety of spectral sensitivity curve shapes are known. The choice and relative proportion of dyes depends on the region of the spectrum to which sensitivity is desired and on the shape of the spectral sensitivity desired.

Examples of sensitizing dyes can be found in Venkataraman, *The Chemistry of Synthetic Dyes*, Academic Press, New York, 1971, Chapter V, James, *The Theory of the Photographic Process*, 4th Ed., Macmillan, 1977, Chapter 8, F. M. Hamer, *Cyanine Dyes and Related Compounds*, John Wiley and Sons, 1964, and in Research Disclosure 308119, Section III, 1989.

The silver halide emulsions for use in this invention can contain optical brighteners, antifogging agents and stabilizers, filtering and antihalo dyes, hardeners, coating aids, plasticizers and lubricants and other auxiliary substances, as for instance described in Research Disclosure 17643, Sections V, VI, VIII, X, XI and XII, 1978, and in Research Disclosure 308119, Sections V, VI, VIII, X, XI, and XII, 1989.

The silver halide emulsion for use in the present invention can be used for the manufacture of multilayer light-sensitive silver halide color photographic elements, such as color negative. photographic elements, color reversal photographic elements, color positive photographic elements and the like, the preferred ones being color negative photographic elements.

Silver halide multilayer color photographic elements usually comprise, coated on a support, a red sensitized silver halide emulsion layer associated with cyan dye-forming color couplers, a green sensitized silver halide emulsion layer associated with magenta dye-forming color couplers and a blue sensitized silver halide emulsion layer associated with yellow dye-forming color couplers. Each layer can be comprised of a single emulsion layer or of multiple emulsion sub-layers sensitive to a given region of visible spectrum. When multilayer materials contain multiple blue, green or red sub-layers, there can be in any case relatively faster and relatively slower sub-layers. These elements additionally comprise other non-light sensitive layers, such as intermediate layers, filter layers, antihalation layers and protective layers, thus forming a multilayer structure. These color photographic elements, after imagewise exposure to actinic radiation, are processed in a chromogenic developer to yield a visible color image. The layer units can be coated in any conventional order, but in a preferred layer arrangement the red-sensitive layers are coated nearest the support and are overcoated by the green-sensitive layers, a yellow filter layer and the blue-sensitive layers.

Suitable color couplers are preferably selected from the couplers having diffusion preventing groups, such as groups having a hydrophobic organic residue of about 8 to 32 carbon atoms, introduced into the coupler molecule in a non-splitting-off position. Such a residue is called a "ballast group". The ballast group is bonded to the coupler nucleus directly or through an imino, ether, carbonamido, sulfonamido, ureido, ester, imido, carbamoyl, sulfamoyl bond, etc. Examples of suitable ballasting groups are described in U.S. Pat. No. 3,892,572.

Said non-diffusible couplers are introduced into the light-sensitive silver halide emulsion layers or into non-light-sensitive layers adjacent thereto. On exposure and color development, said couplers give a color which is complementary to the light color to which the silver halide emulsion layers are sensitive. Consequently, at least one non-diffusible cyan-image forming color coupler, generally a phenol or an α-naphthol compound, is associated with red-sensitive silver halide emulsion layers, at least one non-diffusible magenta image-forming color coupler, generally a 5-pyrazolone or a pyrazolotriazole compound, is associated with green-sensitive silver halide emulsion layers and at least one non-diffusible yellow image forming color coupler, generally an acylacetanilide compound, is associated with blue-sensitive silver halide emulsion layers.

Said color couplers may be 4-equivalent and/or 2-equivalent couplers, the latter requiring a smaller amount of silver halide for color production. As it is well known, 2-equivalent couplers derive from 4-equivalent couplers since, in the coupling position, they contain a substituent which is released during coupling reaction. 2-equivalent couplers which may be used in silver halide color photographic elements include both those substantially colorless and those which are colored ("masking couplers"). The 2-equivalent couplers also include white couplers which do not form any dye on reaction with the color developer oxidation products. The 2-equivalent color couplers include also DIR couplers which are capable of releasing a diffusing development inhibiting compound on reaction with the color developer oxidation products.

The most useful cyan-forming couplers are conventional phenol compounds and α-naphthol compounds. Examples of cyan couplers can be selected from those described in U.S. Pat. No. 2,369,929; 2,474,293; 3,591,383; 2,895,826; 3,458,315; 3,311,476; 3,419,390; 3,476,563 and 3,253,924; in British patent 1,201,110, and in Research Disclosure 308119, Section VII, 1989.

The most useful magenta-forming couplers are conventional pyrazolone type compounds, indazolone type compounds, cyanoacetyl compounds, pyrazolotriazole type compounds, etc, and particularly preferred couplers are pyrazolone type compounds. Magenta-forming couplers are described for example in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, in DE patent 1,810,464, in DE patent applications 2,408,665, 2,417,945, 2,418,959 and 2,424,467; in JP patent applications 20,826/76, 58,922/77, 129,538/74, 74,027/74, 159,336/75, 42,121/77, 74,028/74, 60,233/75, 26,541/76 and 55,122/78, and in Research Disclosure 308119, Section VII, 1989.

The most useful yellow-forming couplers are conventional open-chain ketomethylene type couplers. Particular examples of such couplers are benzoylacetanilide type and pivaloyl acetanilide type compounds. Yellow-forming couplers that can be used are specifically described in U.S. Pat. Nos. 2,875,057, 3,235,924, 3,265,506, 3,278,658, 3,369,859, 3,408,194, 3,415,652 3,528,322, 3,551,151, 3,682,322, 3,725,072 and 3,891,445, in DE patents 2,219,917, 2,261,361 and 2,414,006, in GB patent 1,425,020, in JP patent 10,783/76 and in JP patent applications 26,133/72, 73,147/73, 102,636/76, 6,341/75, 123,342/75, 130,442/75, 1,827/76, 87,650/75, 82,424/77 and 115,219/77, and in Research Disclosure 308119, Section VII, 1989.

Colored couplers can be used which include those described for example in U.S. Pat. Nos. 3,476,560, 2,521,908 and 3,034,892, in JP patent publications 2,016/69, 22,335/63, 11,304/67 and 32,461/69, in JP patent applications 26,034/76 and 42,121/77 and in DE patent application 2,418,959. The light-sensitive silver halide color photographic element may contain high molecular weight color couplers as described for example in U.S. Pat. No. 4,080,211, in EP Pat. Appl. No. 27,284 and in DE Pat. Appl. Nos. 1,297,417, 2,407,569, 3,148,125, 3,217,200, 3,320,079, 3,324,932, 3,331,743, and 3,340,376, and in Research Disclosure 308119, Section VII, 1989.

Colored cyan couplers can be selected from those described in U.S. Pat. No. 3,934,802; 3,386,301 and 2,434,272, colored magenta couplers can be selected from the colored magenta couplers described in U.S. Pat. No. 2,434,272; 3,476,564 and 3,476,560 and in British patent 1,464,361. Colorless couplers can be selected from those described in British patents 861,138; 914,145 and 1,109,963 and in U.S. Pat. No. 3,580,722 and in Research Disclosure 308119, Section VII, 1989.

Also, couplers providing diffusible colored dyes can be used together with the above mentioned couplers for improving graininess and specific examples of these couplers are magenta couplers described in U.S. Pat. No. 4,366,237 and GB Pat. No. 2,125,570 and yellow, magenta and cyan couplers described in EP Pat. No. 96,873, in DE Pat. Appl. No. 3,324,533 and in Research Disclosure 308119, Section VII, 1989.

Also, among the 2-equivalent couplers are those couplers which carry in the coupling position a group which is released in the color development reaction to give a certain photographic activity, e.g. as development inhibitor or accelerator or bleaching accelerator, either directly or after removal of one or further groups from the group originally released. Examples of such 2-equivalent couplers include the known DIR couplers as well as DAR, FAR and BAR couplers Typical examples of said couplers are described in DE Pat. Appl. Nos. 2,703,145, 2,855,697, 3,105,026, 3,319,428, 1,800,420, 2,015,867, 2,414,006, 2,842,063, 3,427,235, 3,209,110, and 1,547,640, in GB Pat. Nos. 953,454 and 1,591,641, in EP Pat. Appl. Nos. 89,843, 117,511, 118,087, 193,389, and 301,477 and in Research Disclosure 308119, Section VII, 1989.

Examples of non-color forming DIR coupling compounds which can be used in silver halide color elements include those described in U.S. Pat. Nos. 3,938,996; 3,632,345; 3,639,417; 3,297,445 and 3,928,041; in German patent applications S.N. 2,405,442; 2,523,705; 2,460,202; 2,529,350 and 2,448,063; in Japanese patent applications S.N. 143,538/75 and 147,716/75, in British patents 1,423,588 and 1,542,705 and 301,477 and in Research Disclosure 308119, Section VII, 1989.

In order to introduce the couplers into the silver halide emulsion layer, some conventional methods known to the skilled in the art can be employed. According to U.S. Pat. Nos. 2,322,027, 2,801,170, 2,801,171 and 2,991,177, the couplers can be incorporated into the silver halide emulsion layer by the dispersion technique, which consists of dissolving the coupler in a water-immiscible high-boiling organic solvent and then dispersing such a solution in a hydrophilic colloidal binder under the form of very small droplets. The preferred colloidal binder is gelatin, even if some other kinds of binders can be used.

Another type of introduction of the couplers into the silver halide emulsion layer consists of the so-called "loaded-latex technique". A detailed description of such technique can be found in BE patents 853,512 and 869,816, in U.S. Pat. No. 4,214,047 and 4,199,363 and in EP patent 14,921. It consists of mixing a solution of the couplers in a water-miscible organic solvent with a polymeric latex consisting of water as a continuous phase and of polymeric particles having a mean diameter ranging from 0.02 to 0.2 micrometers as a dispersed phase.

Another useful method is further the Fisher process. According to such a process, couplers having a water-soluble group, such as a carboxyl group, a hydroxy group, a sulfonic group or a sulfonamido group, can be added to the photographic layer for example by dissolving them in an alkaline water solution.

Useful methods of introduction of couplers into silver halide emulsions are described in Research Disclosure 308119, Section VII, 1989.

The layers of the photographic elements can be coated on a variety of supports, such as cellulose esters supports (e.g., cellulose triacetate supports), paper supports, polyesters film supports (e.g., polyethylene terephthalate film supports or polyethylene naphthalate film supports), and the like, as described in Research Disclosure 308119, Section XVII, 1989.

The photographic elements according to this invention, may be processed after exposure to form a visible image upon association of the silver halides with an alkaline aqueous medium in the presence of a developing agent contained in the medium or in the material, as known in the art. The aromatic primary amine color developing agent used in the photographic color developing composition can be any of known compounds of the class of p-phenylendiamine derivatives, widely employed in various color photographic process. Particularly useful color developing agents are the p-phenylendiamine derivatives, especially the N,N-dialkyl-p-phenylene diamine derivatives wherein the alkyl groups or the aromatic nucleus can be substituted or not substituted.

Examples of p-phenylene diamine developers include the salts of: N,N-diethyl-p-phenylendiamine, 2-amino-5-diethylamino-toluene, 4-amino-N-ethyl-N-(α-methanesulphonamidoethyl)-m-toluidine, 4-amino-3-methyl-N-ethyl-N-(α-hydroxy-ethyl)-aniline, 4-amino-3-(α-methylsulfonamidoethyl)-N,N-diethylaniline, 4-amino-N,N-diethyl-3-(N'-methyl-α-methylsulfonamido)-aniline, N-ethyl-N-methoxy-ethyl- 3-methyl-p-phenylenediamine and the like, as described, for instance, in U.S. Pat. Nos. 2,552,241; 2,556,271; 3,656,950 and 3,658,525.

Examples of commonly used developing agents of the p-phenylene diamine salt type are: 2-amino-5-diethylaminotoluene hydrochloride (generally known as CD2 and used in the developing solutions for color positive photographic material), 4-amino-N-ethyl-N-(α-methanesulfonamidoethyl)-m-toluidine sesquisulfate monohydrate (generally known as CD3 and used in the developing solution for photographic papers and color reversal materials) and 4-amino-3-methyl-N-ethyl-N-(β-hydroxyethyl)-aniline sulfate (generally known as CD4 and used in the developing solutions for color negative photographic materials).

Said color developing agents are generally used in a quantity from about 0.001 to about 0.1 moles per liter, preferably from about 0.0045 to about 0.04 moles per liter of photographic color developing compositions.

In the case of color photographic materials, the processing comprises at least a color developing bath and, optionally, a prehardening bath, a neutralizing bath, a first (black and white) developing bath, etc. These baths are well known in the art and are described for instance in Research Disclosure 17643, 1978, and in Research Disclosure 308119, Sections XIX and XX, 1989.

After color development, the image-wise developed metallic silver and the remaining silver salts generally must be removed from the photographic element. This is performed in separate bleaching and fixing baths or in a single bath, called blix, which bleaches and fixes the image in a single step. The bleaching bath is a water solution having a pH equal to 5.60 and containing an oxidizing agent, normally a complex salt on an alkali metal or of ammonium and of trivalent iron with an organic acid, e.g. EDTA.Fe.$NH_4$, wherein EDTA is the ethylenediaminotetracetic acid. While processing, this bath is continuously aired to oxidize the divalent iron which forms while bleaching the silver image and regenerated, as known in the art, to maintain the bleach effectiveness. The bad working of these operations may cause the drawback of the loss of cyan density of the dyes.

Further to the above mentioned oxidizing agents, the blix bath can contain known fixing agents, such as for example ammonium or alkali metal thiosulfates, Both bleaching and fixing baths can contain other additives, e.g., polyalkyleneoxide compounds, as described for example in GB patent 933,008 in order to increase the effectiveness of the bath, or thioether compounds known as bleach accelerators.

The present invention will be illustrated with reference to the following example, but is should be understood that this example does not limit the present invention.

EXAMPLE 1

A multilayer silver halide color photographic film A was prepared by coating a cellulose triacetate support base, subbed with gelatin, with the following layers in the following order:

(a) a layer of black colloidal silver dispersed in gelatin having a silver coverage of 0.26 g/$m^2$ and a gelatin coverage of 1.33 g/$m^2$;

(b) a layer of low sensitivity red-sensitive silver halide emulsion comprising a sulfur and gold sensitized low-sensitivity silver bromoiodide emulsion (having 2.5% silver iodide moles and a mean grain size of 0.18 μm), optimally spectrally sensitized with sensitizing dyes S-1, S-2 and S-3, at a total silver coverage of 0.72 g/$m^2$ and a gelatin coverage of 0.97 g/$m^2$, containing the cyan-dye forming coupler C-1 at a coverage of 0.357 g/$m^2$, the cyan-dye forming DIR coupler C-2 at a coverage of 0.024 g/$m^2$ and the magenta colored cyan-dye forming masking coupler CM-1 at a coverage of 0.034 g/$m^2$, dispersed in a mixture of tricresylphosphate and butylacetanilide;

(c) a layer of medium-sensitivity red-sensitive silver halide emulsion comprising a sulfur and gold sensitized silver chloro-bromo-iodide emulsion (having 7% silver iodide moles and 5% silver chloride moles and a mean grain size of 0.45 μm), optimally spectrally sensitized with sensitizing dyes S-1, S-2 and S-3, at a silver coverage of 0.84 g/m$^2$ and a gelatin coverage of 0.81 g/m$^2$, containing the cyan-dye forming coupler C-1 at a coverage of 0.324 g/m$^2$, the cyan-dye forming DIR coupler C-2 at a coverage of 0.024 g/m$^2$, and the magenta colored cyan-dye forming masking coupler CM-1 at a coverage of 0.034 g/m$^2$, dispersed in a mixture of tricresylphosphate and butylacetanilide;

(d) a layer of high-sensitivity red-sensitive silver halide emulsion comprising a sulfur and gold sensitized silver bromo-iodide emulsion (having 12% silver iodide moles and a mean grain size of 1.1 μm), optimally spectrally sensitized with sensitizing dyes S-1, S-2 and S-3, at a silver coverage of 1.53 g/m$^2$, and a gelatin coverage of 1.08 g/m$^2$, containing the cyan-dye forming coupler C-1 at a coverage of 0.223 g/m$^2$, and the cyan-dye forming DIR coupler C-2 at a coverage of 0.018 g/m$^2$, and the magenta colored cyan-dye forming masking coupler CM-1 at a coverage of 0.034 g/m$^2$, dispersed in a mixture of tricresylphosphate and butylacetanilide;

(e) an intermediate layer containing 0.10 g/m$^2$ of a fine grain silver bromide emulsion, 1.13 g/m$^2$ of gelatin, 0.025 g/m$^2$ of UV absorber UV-1 and 0.025 g/m$^2$ of UV absorber UV-2;

(f) a layer of low sensitivity green sensitive silver halide emulsion comprising a blend of 63% by weight of the low-sensitivity emulsion of layer (b) and of 37% by weight of the medium-sensitivity emulsion of layer (c) at a silver coverage of 1.44 g/m$^2$, optimally spectrally sensitized with sensitizing dyes S-4 and S-5, at a gelatin coverage of 1.54 g/m$^2$, containing the magenta-dye forming coupler M-1 at a coverage of 0.537 g/m$^2$, the magenta dye forming DIR coupler M-2 at a coverage of 0.017 g/m$^2$, and the yellow colored magenta dye forming couplers M-3 and M-4 at a coverage of 0.205 g/m$^2$, and dispersed in tricresylphosphate;

(g) a layer of high-sensitivity green sensitive silver halide emulsion comprising a sulfur and gold sensitized silver bromo-iodide emulsion (having 12% silver iodide moles and a mean grain size of 1.1 μm), optimally spectrally sensitized with sensitizing dyes with sensitizing dyes S-4 and S-5, at a silver coverage of 1.60 g/m$^2$ and a gelatin coverage of 1.03 g/m$^2$, containing the magenta dye forming coupler M-1 at a coverage of 0.48 g/m$^2$, the magenta dye forming DIR coupler M-2 at a coverage of 0.015 g/m$^2$, and the yellow colored magenta dye forming couplers M-3 and M-4 at a coverage of 0.059 g/m$^2$, dispersed in tricresylphosphate;

(h) an intermediate layer containing 1.06 g/m$^2$ of gelatin, 0.031 g/m$^2$ of UV absorber UV-1 and 0.031 g/m$^2$ of UV absorber UV-2;

(i) a yellow filter layer containing 1.14 g/m$^2$ of gelatin and 0.045 g/m$^2$ of Silver;

(j) a layer of low-sensitivity blue-sensitive silver halide emulsion comprising a blend of 63% by weight of the low-sensitivity emulsion of layer (b) and of 37% by weight of the medium-sensitivity emulsion of layer (c) at a silver coverage of 0.53 g/m$^2$, optimally spectrally sensitized with sensitizing dye S-6, at a gelatin coverage of 1.65 g/m$^2$, containing the yellow dye forming coupler Y-1 at a coverage of 1.42 g/m$^2$ and the yellow dye forming DIR coupler Y-2 at a coverage of 0.027 g/m$^2$, dispersed in a mixture of diethyllauramide and dibutylphthalate;

(k) a layer of high-sensitivity blue sensitive silver halide emulsion comprising a sulfur and gold sensitized silver bromo-iodide emulsion (having 12% silver iodide moles and a mean grain size of 1.1 μm), optimally spectrally sensitized with sensitizing dye S-6, at a silver coverage of 0.92 g/m$^2$ and a gelatin coverage of 1.25 g/m$^2$, containing the yellow dye-forming coupler Y-1 at a coverage of 0.765 g/m$^2$ and the yellow dye forming DIR coupler Y-2 at a coverage of 0.02 g/m$^2$, dispersed in a mixture of diethyllauramide and dibutylphthalate;

(l) a protective layer of 1.29 g/m$^2$ of gelatin, comprising the UV absorber UV-1 at a coverage of 0.12 g/m$^2$, the UV absorber UV-2 at a coverage of 0.12 g/m$^2$, a fine grain silver bromide emulsion at a silver coverage of 0.15 g/m$^2$; and (n) a top coat layer of 0.75 g/m$^2$ of gelatin containing 0.273 g/m$^2$ of polymethylmethacrylate matting agent MA-1 in form of beads having an average diameter of 2.5 micrometers, and the 2,4-dichloro-6-hydroxy-1,3,5-triazine hardener H-1 at a coverage of 0.468 g/m$^2$.

Film B was prepared in a similar manner, but employing, instead of the magenta colored cyan-dye forming masking coupler CM-1, equimolecular amounts (i.e., 96.74 mmol/m$^2$ in total) of the non-coupling, non-diffusible magenta azo dye MD-1 in the layers (b), (c) and (d).

Film C was prepared was prepared in a similar manner, but replacing 0.030 g/m$^2$ of the non-coupling, non-diffusible magenta azo dye MD-1 in each of the layers (b) and (c) with equimolecular amounts of the magenta colored cyan-dye forming masking coupler CM-1.

Samples of Films A, B and C were exposed to a light source having a color temperature of 5,500 K. through a Kodak Wratten TM W98 filter (selective blue exposure). Other samples of Films A and B were exposed to a light source having a color temperature of 5500 K. The exposed samples were then color processed using the conventional C41 process as described in *British Journal of Photography*, Jul. 12, 1974, pp. 597–598, in the following sequence:

1. Color development
2. Stop
3. Bleach
4. Fix
5. Stabilization
6. Drying

For each selectively exposed and color processed sample, the characteristic curves for the red, green and blue light absorptions were obtained conventionally. Values of minimum density (Dmin), maximum density (Dmax), sensitivity in Log E at density of 0.2 above Dmin (Speed1) and at density of 1.0 above Dmin (Speed2), and contrast (Gamma) for each Film are reported in Table 1.

TABLE 1

| Film | Compound | mmol/m$^2$ | Layer | Dmin | Dmax | Speed1 | Speed2 | Gamma |
|---|---|---|---|---|---|---|---|---|
| A (Comp.) | AD-1 | 0 | Cyan | 0.28 | 2.17 | 2.07 | 0.76 | 0.56 |
| | and | | Magenta | 0.64 | 2.49 | 2.25 | 0.82 | 0.51 |
| | CM-1 | 96.74 | Yellow | 0.86 | 3.02 | 2.33 | 1.28 | 0.72 |
| B (Comp.) | AD-1 | 96.74 | Cyan | 0.28 | 2.22 | 2.07 | 0.80 | 0.58 |
| | and | | Magenta | 0.65 | 2.85 | 2.35 | 1.17 | 0.65 |
| | CM-1 | 0 | Yellow | 0.86 | 3.12 | 2.34 | 1.32 | 0.74 |
| C (Inv.) | AD-1 | 55.43 | Cyan | 0.28 | 2.15 | 2.06 | 0.75 | 0.55 |
| | and | | Magenta | 0.63 | 2.74 | 2.33 | 1.10 | 0.62 |
| | CM-1 | 41.31 | Yellow | 0.85 | 3.05 | 2.31 | 1.26 | 0.71 |

Sensitometry of samples of Films A, B and C reveals that, by replacement of part of the cyan masking coupler CM-1 with the magenta azo dye AD-1, Dmin of the magenta layer and speed of the cyan layer remain substantially unchanged, but a substantial improvement of the magenta speed can be achieved. Moreover, partial replacement of the cyan masking coupler CM-1 with the magenta azo dye AD-1 does not cause a significant difference in color reproduction (evaluated, for example, colorimetrically in accordance with DIN 6174 using the CIELAB 1976 system) versus film A using only the cyan masking coupler CM-1.

Formulas of compounds used in the present invention will be presented below.

Cyan dye forming coupler C-1:

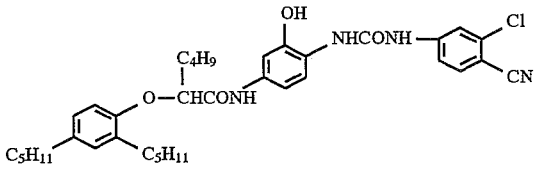

Cyan dye forming DIR coupler C-2:

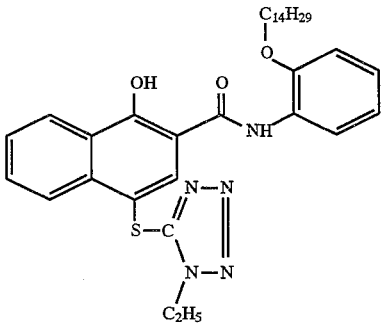

Magenta colored cyan dye forming coupler CM-1:

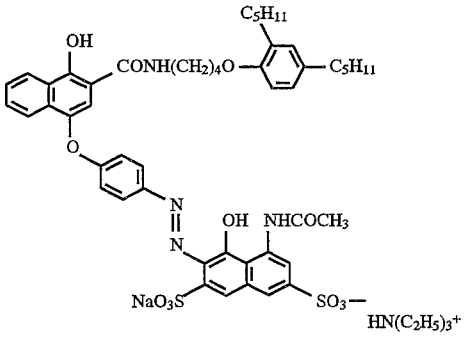

Cyan dye forming coupler C-4:

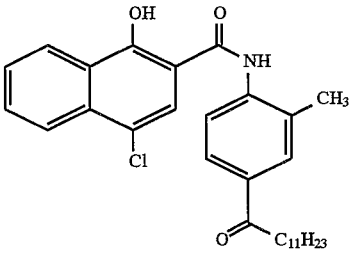

Magenta dye forming coupler M-1:
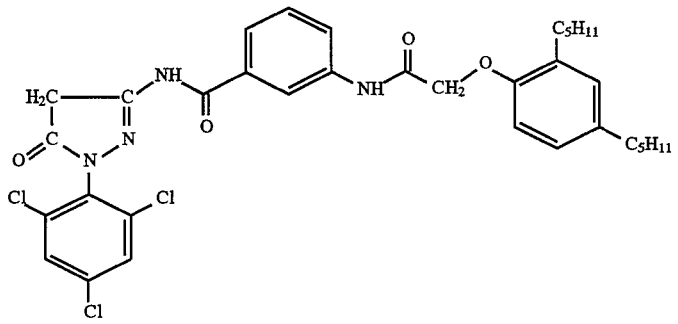
Magenta dye forming DIR coupler M-2:
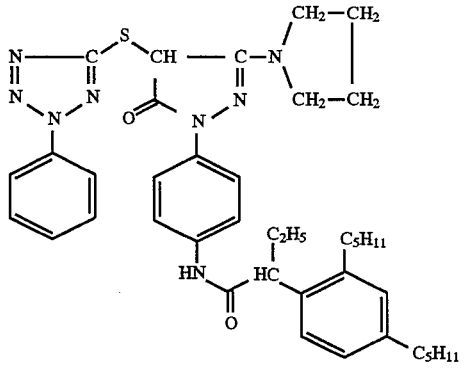
Yellow dye forming coupler Y-1:
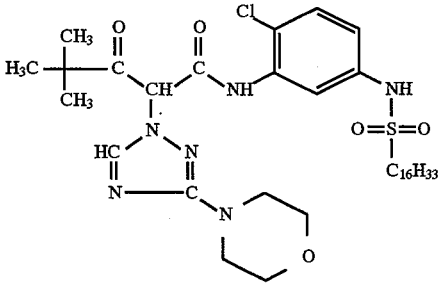
Yellow colored magenta dye forming coupler M-3:
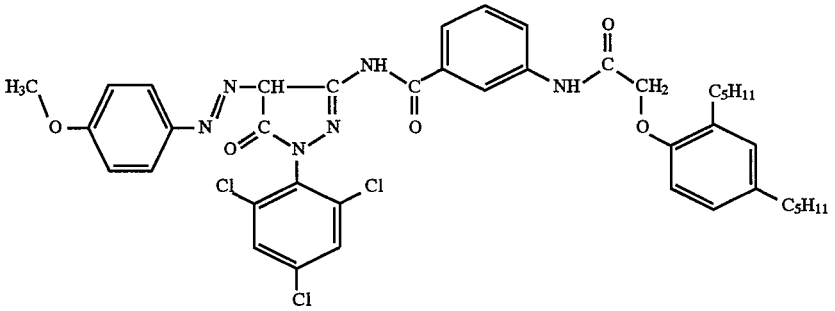
Yellow colored magenta dye forming coupler M-4:
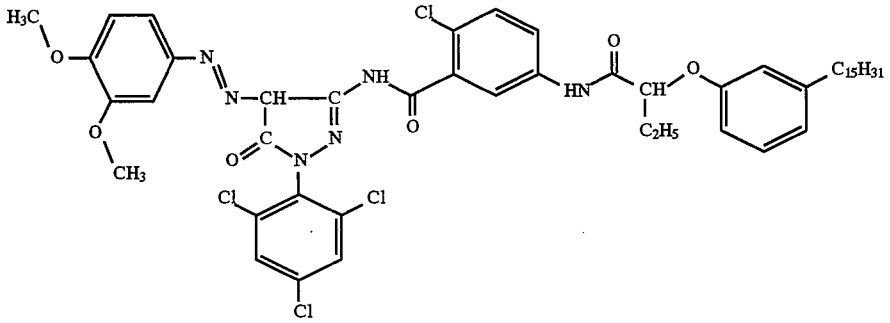

Yellow dye forming DIR coupler Y-2:
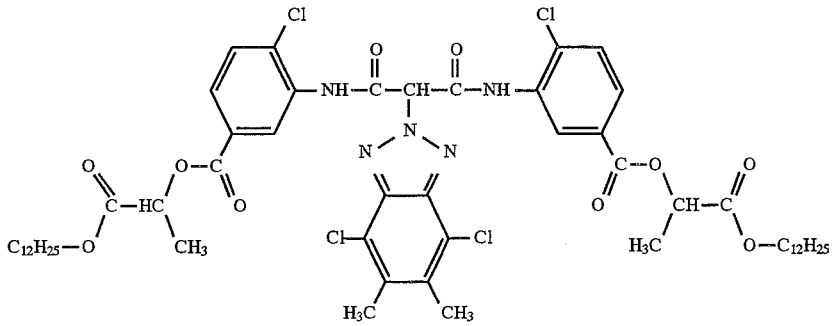
Red Sensitizer S-1
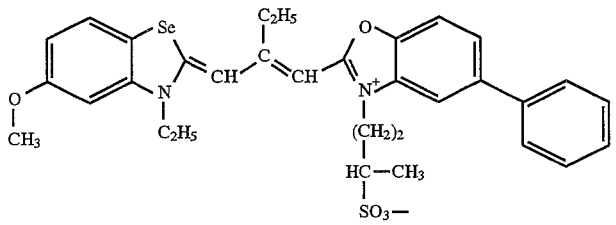
Red Sensitzer S-2
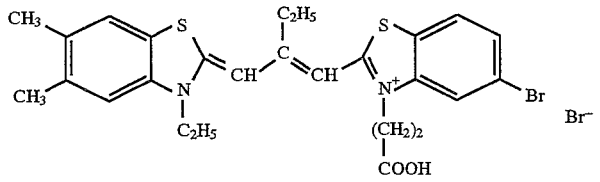
Red Sensitizer S-3
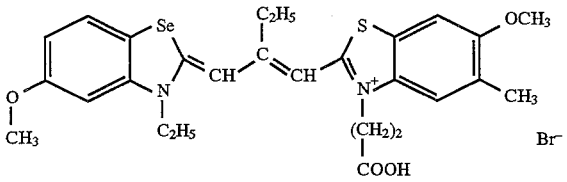
Green Sensitizer S-4
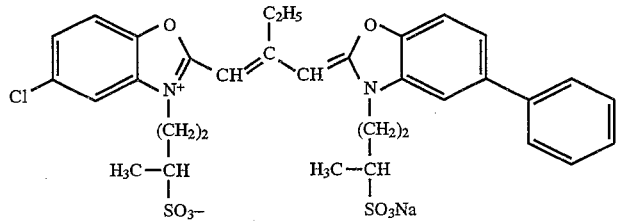

Green Sensitizer S-5

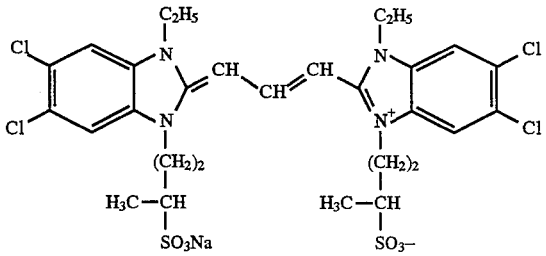

Blue Sensitizer S-6

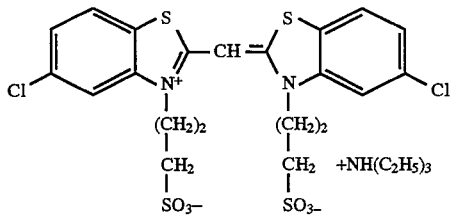

UV Absorber UV-1:

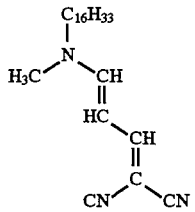

Matting agent MA-1:

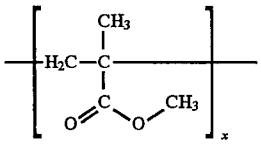

Hardener H-1:

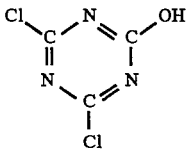

UV Absorber UV-2:

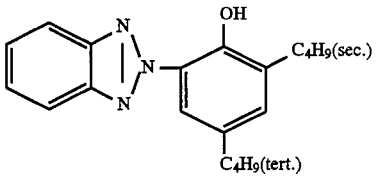

We claim:

1. A multilayer silver halide photographic element comprising a support having thereon at least a blue sensitive silver halide emulsion layer containing a yellow dye-forming coupler, at least a green-sensitive silver halide emulsion layer containing a magenta dye-forming coupler, and at least a red-sensitive silver halide emulsion layer containing a cyan dye-forming coupler, characterized in that said red-sensitive layer contains a non-diffusible, non-coupling magenta colored diazo dye and a non-diffusible, cyan dye-forming magenta masking coupler.

2. The photographic element according to claim 1 wherein said non-diffusible, non-coupling magenta colored diazo dye is represented by the formula

[Ar]—N=N—[Ph]

wherein Ar represents an aryl group, Ph represents a phenyl group, said dye comprising on said Ar at least one water solubilizing group and on said Ph at least one ballast group.

3. The photographic element according to claim 1 wherein said non-diffusible, non-coupling magenta colored azo dye is represented by the formula (II)

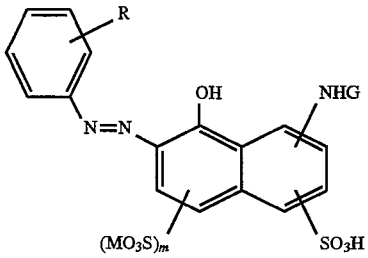

(II)

wherein M is hydrogen or a monovalent cation, m is an integer of 0 or 1, G represents an acyl group, an alkylsulfonyl group or an arylsulfonyl group, and R is a ballast group.

4. The photographic element according to claim 1 wherein said non-diffusible, non-coupling magenta colored azo dye is represented by the formula (III)

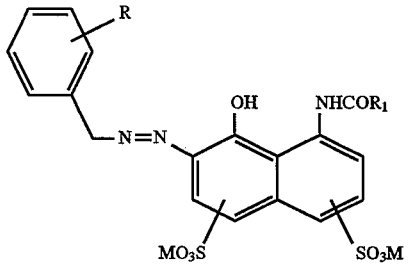

(III)

wherein M is a hydrogen atom or a cation, R is a ballast group, and $R_1$ is an alkyl group.

5. The photographic element according to claim 1 wherein said non-diffusible, non-coupling magenta colored azo dye is represented by the formula

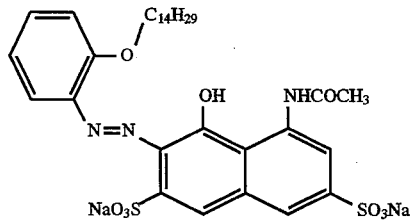

6. The photographic element according to claim 1 wherein said non-diffusible, cyan dye-forming magenta masking coupler is represented by the following general formula (IV)

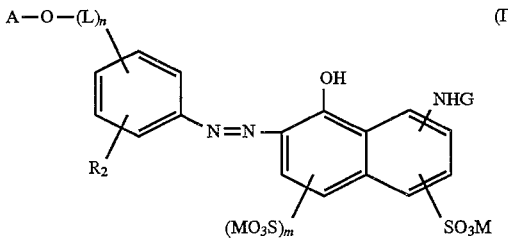

(IV)

wherein A represents a cyan coupler residue, L represents a divalent linking group connected to the Coupling position of the cyan coupler through O, n is an integer of 0 or 1, $R_2$ represents a photographically inactive monovalent group, M represents a hydrogen atom or a cation, m is an integer of 0 or 1, and G represents an acyl group, an alkysulfonyl group, or an arylsulfonyl group.

7. The photographic element according to claim 1 wherein said non-diffusible, non-coupling magenta colored azo dye and said non-diffusible, cyan dye-forming magenta masking coupler are incorporated in a red-sensitive silver halide emulsion layer in combination with a non-diffusible phenol or naphthol cyan dye forming coupler.

8. The photographic element according to claim 1 wherein said non-diffusible, non-coupling magenta colored azo dye is incorporated in the photographic element in an amount of from 10 to 200 $mg/m^2$.

9. The photographic element according to claim 1 wherein said non-diffusible, cyan dye-forming magenta masking coupler is incorporated in the photographic element in an amount of from 10 to 500 $mg/m^2$.

* * * * *